US008357337B2

(12) United States Patent
Rylski et al.

(10) Patent No.: US 8,357,337 B2
(45) Date of Patent: Jan. 22, 2013

(54) PIPETTE WITH ADJUSTABLE VOLUME OF ASPIRATED LIQUID

(75) Inventors: Romuald Andrzej Rylski, Warsaw (PL); Wojciech Sarna, Warsaw (PL); Jan Bala, Pultusk (PL)

(73) Assignee: PZ HTL Spolka Akcyjna, Warsaw (PL)

( * ) Notice: Subject to any disclaimer, the term of this patent is extended or adjusted under 35 U.S.C. 154(b) by 332 days.

(21) Appl. No.: 12/680,686

(22) PCT Filed: Jan. 11, 2008

(86) PCT No.: PCT/PL2008/000005

§ 371 (c)(1),
(2), (4) Date: Mar. 29, 2010

(87) PCT Pub. No.: WO2009/067030

PCT Pub. Date: May 28, 2009

(65) Prior Publication Data

US 2010/0266453 A1 Oct. 21, 2010
US 2012/0087846 A2 Apr. 12, 2012

(30) Foreign Application Priority Data

Nov. 23, 2007 (PL) ..... 383865

(51) Int. Cl.
*B01L 3/02* (2006.01)

(52) U.S. Cl. ..... 422/516; 73/864.18

(58) Field of Classification Search ..... 422/516; 73/864.18

See application file for complete search history.

(56) References Cited

U.S. PATENT DOCUMENTS 4,395,921 A 8/1983 Oppenlander
5,104,624 A * 4/1992 Labriola ..... 422/516
5,650,124 A 7/1997 Gilson
2004/0035228 A1 2/2004 Viot
2005/0039550 A1 * 2/2005 Uldry et al. ..... 73/864.18
2005/0142038 A1 6/2005 Petrek et al.

OTHER PUBLICATIONS

International Searching Authority PCT Written Opinion, PCT/PL2008/000005, 4 pages.
International Preliminary Report on Patentability, PCT/PL2008/000005, 8 pages.

* cited by examiner

*Primary Examiner* — Jan Ludlow
(74) *Attorney, Agent, or Firm* — Edell, Shaprio & Finnan, LLC

(57) ABSTRACT

Pipette with adjustable volume of aspirated liquid built of a handle (1) and of a nozzle (3) and of coupled with them: an exchangeable pipette tip ejection mechanism, a drawing up and discharging mechanism with a plunger (12) arranged in said pipette nozzle (3), a plunger working stroke adjustment mechanism with at least one driving member (16), a manually actuated lock mechanism locking a drive assembly of an adjustment screw of a plunger working stroke, an engaging mechanism which engages said plunger working stroke adjustment mechanism with a counter (14) of an aspirated liquid volume by said pipette, a calibration mechanism for a change of a pipette calibration coefficient, whereas said driving member (16) of said drive assembly of said adjustment screw of the plunger working stroke is accessible from outside through at least one window (38) in a wall of said handle (1), said pipette is characterized in that said lock mechanism of said drive assembly of said adjustment screw of the plunger working stroke comprises a lock member which is non-rotatably mounted relative to said pipette handle (1) and is axially slidable between LOCKED POSITION and UNLOCKED POSITION of said plunger working stroke adjustment mechanism, whereas said driving member (16) of said drive assembly of said adjustment screw of the plunger working stroke is axially fixedly and rotatably mounted relative to said pipette handle (1).

20 Claims, 5 Drawing Sheets

PIPETTE WITH ADJUSTABLE VOLUME OF ASPIRATED LIQUID

TECHNICAL FIELD

The invention relates to a pipette with adjustable volume of aspirated liquid for aspirating, transferring and dispensing a liquid.

BACKGROUND ART

From the state of art electronic and mechanical pipettes with adjustable volume of aspirated liquid are known, which are built in the upper part of a handle and in the lower part of a nozzle terminated with a cone for an exchangeable tip as well as of coupled with them and cooperating with one another mechanisms which realize different functions in the pipette.

An exchangeable pipette tip ejection mechanism comprises an ejector push button seated in the upper part of the pipette handle and an ejector seated with its lower end onto the pipette nozzle.

A drawing up and discharging mechanism comprises a pipetting push button connected via a pipetting rod to a piston assembly of which the plunger is placed in the pipette nozzle and is slidable therein in PIPETTING MODE of the pipette from and to its upper position. The plunger is driven towards the exchangeable tip by force which is manually applied by an user to the pipetting push button. In the opposite direction, the plunger is driven in PIPETTING MODE by the force of the pipetting spring until it rests on an end stop mounted in a plunger working stroke adjustment mechanism.

In ADJUSTMENT MODE, a position of an upper limiter of the plunger working stroke is changed by means of an adjustment screw of the drive assembly of the plunger working stroke adjustment mechanism. The drive assembly of the plunger working stroke adjustment mechanism has at least one driving member which is accessible for the user from outside through at least one window in a wall of the handle. The plunger working stroke adjustment mechanism controls a length of a plunger movement that is performed during liquid pipetting in PIPETTING MODE.

The plunger working stroke adjustment mechanism is via an engaging mechanism engaged with a counter to indicate the volume of the liquid aspirated by the pipette in PIPETTING MODE into the exchangeable tip, whereas the liquid volume is previously set by the user in ADJUSTMENT MODE by selection of a setting of the plunger working stroke.

Thus, the length of the plunger movement that is its working stroke in the nozzle during pipetting in PIPETTING MODE is altered by the user due to resetting structure elements of the plunger working stroke adjustment mechanism in ADJUSTMENT MODE, which simultaneously results in a change of indications of the counter indicating the set and desired liquid volume.

The pipettes are further provided with a calibration mechanism which enables, in CALIBRATION MODE of the pipette, the change in a calibration coefficient of the pipette. The calibration coefficient determines a relationship between the plunger movement length set by the plunger working stroke adjustment mechanism and the liquid volume indicated by the counter.

For ensuring an easy adjustment of the desired volume value of the drawn-up liquid, in the course of resetting adjustment elements of the plunger working stroke adjustment mechanism in ADJUSTMENT MODE, a torque, which is indispensable for setting change, should be as small as possible. Whereas, after adjustment of the desired volume value during operation with the pipette in PIPETTING MODE, this torque should be sufficiently large to rule out any risk of accidental resetting the pipette to another volume value. This requires to apply in the pipette an additional mechanism for changing a braking torque exerted onto the plunger working stroke adjustment mechanism or an additional mechanism for disengaging external adjustment elements of the plunger working stroke adjustment mechanism from elements changing the end stop position which determines the length of the plunger working stroke.

Therefore, for securing the desired volume value of the drawn-up liquid, which is previously set in ADJUSTMENT MODE, against accidental resetting during operation with the pipette in PIPETTING MODE, the pipettes are provided with a manually actuated lock mechanism locking the adjustment mechanism of the plunger working stroke.

In the known pipettes, the lock mechanism of the plunger working stroke adjustment mechanism, which constitutes a releasable friction brake, is more often applied. This lock mechanism provides after its actuation the large braking torque exerted onto the plunger working stroke adjustment mechanism and preventing from unintentional resetting in PIPETTING MODE the set desired volume value of the liquid aspirated by the pipette and simultaneously provides after its releasing the small braking torque exerted onto the plunger working stroke adjustment mechanism and necessary for adjusting the desired volume value of drawn-up liquid.

From the United States Patent Specification No U.S. Pat. No. 5,650,124 is known the pipette in which for the adjustment of the aspirated liquid volume as the driving member of the plunger working stroke adjustment mechanism a knob is applied, whereas this knob can be moved axially in the handle. When the knob is moved downward into the interior of the handle, the knob enters a seat in the handle and due to friction forces acting the torque indispensable to turn the knob and thereby to re-adjust the volume in the pipette is large. In this manner, the same structure element, that is the knob of the driving member of the plunger working stroke adjustment mechanism, simultaneously is a lock member of the lock mechanism which locks the adjustment mechanism of the plunger working stroke. When the knob is withdrawn from the handle, the braking torque exerted onto the plunger working stroke adjustment mechanism decreases, which enables easy re-adjustment of the volume setting. However, in this pipette with the friction brake of the volume setting, inadvertent re-adjustment of the volume setting is possible, because the knob, during locking the volume setting in course of moving the knob downward into the seat in the handle, can simultaneously realize a rotational motion and a sliding motion in relation to the handle, whereas the rotational motion of the knob results in the change of the aspirated liquid volume setting. Moreover, in this pipette, the lock mechanism, which locks the plunger working stroke adjustment mechanism, is the releasable friction brake between the driving member of the adjustment mechanism and a wall of the handle. Thus, any dimensional inaccuracies of the handle or disadvantageous variations in the handle dimensions, which arisen in consequence of autoclaving, results in disadvantageous changes of the value of the braking torque which is exerted in this friction brake onto the adjustment mechanism of the plunger working stroke.

From the patent specification U.S. Pat. No. 5,849,248 is also known the pipette, in which changes in the setting of the aspirated liquid volume are realized by a rotation of the pipetting push button in two directions, whereas the pipetting push button is the driving member of the plunger working stroke adjustment mechanism. While, as the lock mechanism locking the plunger working stroke adjustment mechanism is applied the friction brake which is actuated and releasable by means of an additional knob in the upper part of the handle below the pipetting push button and is movable between LOCKED POSITION and UNLOCKED POSITION of the plunger working stroke adjustment mechanism. This friction brake acts directly onto an adjustment screw of the plunger working stroke producing the braking torque between the adjustment screw and a wall of the handle by respectively formed structure elements of the lock mechanism. In this pipette, the volume is reset only by rotation of the pipetting push button in two direction, whereas due to the adjustment function of the pipetting push button and simultaneous close relative location of the pipetting push button being the driving member of the adjustment mechanism and the knob of the lock mechanism connected with its lock member, in course of actuation or releasing the friction brake by turning the knob of the lock mechanism locking the plunger working stroke adjustment mechanism between LOCKED POSITION and UNLOCKED POSITION, the accidental change of the setting of the aspirated liquid volume by unintentional rotation of the pipetting push button can take place. Moreover, the location of the lock mechanism knob on the upper wall of the handle and below the pipetting push button also creates in course of pipetting in PIPETTING MODE a danger of an inadvertent release of the friction brake from LOCKED POSITION of the plunger working stroke adjustment mechanism by accidental turn of the lock mechanism knob. Further, this pipette requires to be operated with two hands. Firstly, because of the structure of the lock mechanism. Secondly, the operating with the pipetting push button which performs two functions, namely turning with the pipetting push button when it realizes the function of the driving member of the adjustment mechanism and pushing down the pipetting push button as the element of the drawing up and discharging mechanism into the handle during pipetting for expelling the aspirated liquid from the tip, by means of one hand is also uncomfortable.

In turn, from the application specification US 2004/0035228 is known the pipette, in which, instead of the friction brake, as the lock mechanism locking the plunger working stroke adjustment mechanism is applied a coupling which decouples the pipetting push button, being simultaneously the driving member knob of the plunger working stroke adjustment mechanism, from the adjustment screw of the plunger working stroke. In the effect, after the actuation of the coupling, it is possible in ADJUSTMENT MODE to adjust easily the desired volume value of the liquid and that is both by means of the pipetting push button and by means of the knob inside the handle, which knob constitutes after the coupling actuation another driving member of the plunger working stroke adjustment mechanism and which simultaneously serves for disengagement/engagement of the coupling between LOCKED and UNLOCKED POSITIONS of the plunger working stroke adjustment mechanism. After disengagement of the coupling, that is after moving, inside the handle, the knob as the driving member of the adjustment mechanism to LOCKED POSITION of the plunger working stroke adjustment mechanism, turning with the pipetting push button as well as turning with the knob inside the handle does not cause the adjustment screw of the plunger working stroke to rotation and thereby does not change the preset volume of the aspirated liquid. In LOCKED POSITION of the plunger working stroke adjustment mechanism, the adjustment mechanism, which are situated in different locations in the pipette handle to increase operational comfort of the pipette due to its convenient one-hand operation.

The aimed objects have been achieved in the pipette with the adjustable volume of the aspirated liquid according to the present invention the essence of which is presented below.

A pipette with an adjustable volume of an aspirated liquid, according to the present invention, is built of a handle and of a nozzle and of coupled with them

- an exchangeable pipette tip ejection mechanism comprising an ejector push button seated in the upper part of the pipette handle and the ejector seated with its lower end onto the pipette nozzle,
- an drawing up and discharging mechanism comprising a pipetting push button connected via a pipetting rod with a piston assembly of which a plunger is placed in the pipette nozzle,
- a plunger working stroke adjustment mechanism provided with a drive assembly of an adjustment screw of a plunger working stroke with at least one driving member,
- a manually actuated lock mechanism to lock said plunger working stroke adjustment mechanism,
- an engaging mechanism to engage said plunger working stroke adjustment mechanism with a counter for indication the volume of the liquid aspirated by the pipette depending on the set plunger working stroke,
- a calibration mechanism to change a pipette calibration coefficient determining a relationship between a plunger movement length, which is set by said plunger working stroke adjustment mechanism, and the liquid volume indicated in said counter, whereas said driving member of said drive assembly of said adjustment screw of the plunger working stroke is accessible from outside through at least one window in a wall of the handle, wherein in the pipette said lock mechanism locking said plunger working stroke adjustment mechanism comprises a lock member which is non-rotationally mounted relative to said pipette handle and is axially slidable between LOCKED POSITION and UNLOCKED POSITION of the plunger working stroke adjustment mechanism, whereas said driving member of said drive assembly of said adjustment screw of the plunger working stroke is fixed axially and mounted rotationally relative to the pipette handle.

Preferably, said driving member of said drive assembly of said adjustment screw of the plunger working stroke is via said pipetting rod coupled immovably in the rotation direction with said pipetting push button of said drawing up and discharging mechanism.

Preferably, said lock member is mounted slidably in the axial direction onto said driving member of said drive assembly of said adjustment screw of the plunger working stroke and mounted non-rotationally in said pipette handle.

Preferably, said lock mechanism locking said plunger working stroke adjustment mechanism is a friction brake between said lock member and said driving member, whereas said lock member has a frictional surface on an inner cone and said driving member has a frictional surface on an outer cone.

Preferably, angles of said inner and outer cones of said frictional surfaces are equal.

Preferably, said lock member is a braking the sleeve.

Preferably, said lock member is provided with an elastic braking element of the axial movement of said lock member in said pipette handle in UNLOCKED POSITION of said plunger working stroke adjustment mechanism.

Preferably, said driving member of said drive assembly of said adjustment screw of the plunger working stroke is fixed in axial direction relative to said pipette handle by an interlock which is releasable from said driving member for its displacement in axial direction during the pipette disassembly.

Preferably, said lock member has an outer surface which facilitates a grip.

The advantage of the pipette, following the invention, is that in the pipette is applied the lock mechanism locking the plunger working stroke adjustment mechanism and provided with the additional lock member, different than the driving member of the plunger working stroke adjustment mechanism or than the pipetting push button of the drawing up and discharging mechanism, whereas the operation of the lock member enables easy and quick changing over the pipette from ADJUSTMENT MODE to PIPETTING MODE after the adjustment of the aspirated liquid, volume but simultaneously guarantees the reliability and repeatability of the chosen volume setting both in course of the operation mode change into the one chosen from CALIBRATION, PIPETTING and ADJUSTMENT MODES and in course of the primary operation mode of the pipette that is PIPETTING MODE.

In the present pipette, the lock member of the lock mechanism locking the working stroke adjustment mechanism locks directly the driving member of the adjustment mechanism irrespective of their location relative to the pipette handle, whereas the lock member does not have the possibility to rotate relative to the driving member of the adjustment mechanism and can move only axially relative to the handle. Due to this, the setting of the aspirated liquid volume is secured against accidental modification both in course of the operation mode change into the one chosen from CALIBRATION, PIPETTING and ADJUSTMENT pipette is in PIPETTING MODE. In this pipette, due to the structure of the plunger working stroke adjustment mechanism and the lock mechanism locking this adjustment mechanism, the adjustment of the volume setting of the drawn-up liquid is discrete, and while engaging or disengaging the coupling misadjustment of the desired volume value of the drawn-up liquid can take place. This is because the knob inside the handle is the driving member of the plunger working stroke adjustment mechanism and simultaneously is the lock member of the lock mechanism and as the lock member of the lock mechanism blocks the setting of the liquid volume by disengaging from the adjustment screw of the plunger working stroke and from the counter.

In the pipettes known from the above cited patent specification U.S. Pat. No. 5,650,124 and patent application specification US 2004/0035228,for actuation/release of the lock mechanism locking the plunger working stroke adjustment mechanism is applied the same knob which is also the driving member of the plunger working stroke adjustment mechanism and which serves to set the desired volume value of the drawn-up liquid. It can cause inadvertent resetting of the liquid volume in the moment of actuation/release of the lock mechanism because at the axial motion the knob can simultaneously performs the rotational motion resulting in resetting the previously chosen liquid volume.

DISCLOSURE OF INVENTION

The object of the present invention is to provide the pipette with the lock mechanism locking the plunger working stroke adjustment mechanism and enabling simple and quick changing over the pipette from ADJUSTMENT MODE to PIPETTING MODE after the aspirated liquid volume setting is executed and simultaneously to provide the pipette guaranteeing the reliability and repeatability of the chosen volume setting both in course of the operation mode change into the one chosen from CALIBRATION, PIPETTING and ADJUSTMENT MODES and in course of the primary operation mode of the pipette that is PIPETTING MODE.

Another object of invention is to provide the pipette with the lock mechanism which operates correctly irrespective of variations of the assembling clearances between elements of the cooperating pipette mechanisms and the handle of the pipette, whereas these variations of the assembling clearances results from dimensional inaccuracies or dimension alterations of some elements, including the handle, in effect of cyclic autoclaving.

The object of the invention is also to provide the pipette of a structure enabling to change the aspirated liquid volume setting by means of two different driving members of the MODES and in course of the primary operation mode of the pipette that is PIPETTING MODE and this is irrespective of dimensional correlations of the cooperating with each other pipette mechanisms and the pipette handle.

The lock member of the lock mechanism locking the plunger working stroke adjustment mechanism can slide only axially in the pipette handle and thus it cannot, in course of locking, accidentally turn with the driving member of the adjustment mechanism resetting the length of the plunger motion in the pipette nozzle.

In ADJUSTMENT MODE of the pipette in UNLOCKED POSITION of the plunger working stroke adjustment mechanism, the lock member is moved in the handle window downwards the pipette, thereby facilitating the change of the volume setting of the drawn-up liquid due to the driving member of the adjustment mechanism, which is better accessible for the user hand.

IN PIPETTING MODE of the pipette in LOCKED POSITION of the plunger working stroke adjustment mechanism, the lock member is moved in the handle window upwards the pipette, thereby making it more difficult to change the volume setting of the drawn-up liquid due to the driving member of the adjustment mechanism, which is less accessible for the user hand.

What is next advantageous in the pipette, following the invention, is that re-adjustment of the volume setting of the drawn-up liquid can be realized by the rotation in two direction either by the pipetting push button which is mounted on the end of the pipetting rod of the drawing up and discharging mechanism or by another driving member of the drive assembly of the adjustment screw of the adjustment mechanism, which is accessible from outside in the wall of the pipette handle, and which significantly facilitates the pipette servicing by one hand.

The next advantage of the solution, following the invention, in comparison with the pipettes known is that the lock mechanism with additional lock member is placed inside the pipette handle contour, which additionally decreases a danger of misadjustment of the working stroke adjustment mechanism in UNLOCKED POSITION.

In the preferred embodiment of the present invention, in the pipette, as the lock mechanism locking the plunger working stroke adjustment mechanism the friction brake is applied, in which the lock member transmits the braking torque onto the driving member of the plunger working stroke adjustment mechanism. After adjustment in ADJUSTMENT MODE the desired volume of the liquid aspirated in PIPETTING MODE, the braking torque of the adjustment mechanism is sufficiently large for preventing accidental re-adjustment of the plunger working stroke in PIPETTING MODE, and thereby sufficiently large for preventing accidental change of the liquid volume aspirated by the pipette.

The pipette according to the present invention is conveniently operated by the user one hand.

BRIEF DESCRIPTION OF DRAWINGS

The invention preferred embodiment is presented by way of drawing documentation, in which.

BEST MODE OF CARRYING OUT THE INVENTION

Figure 1:
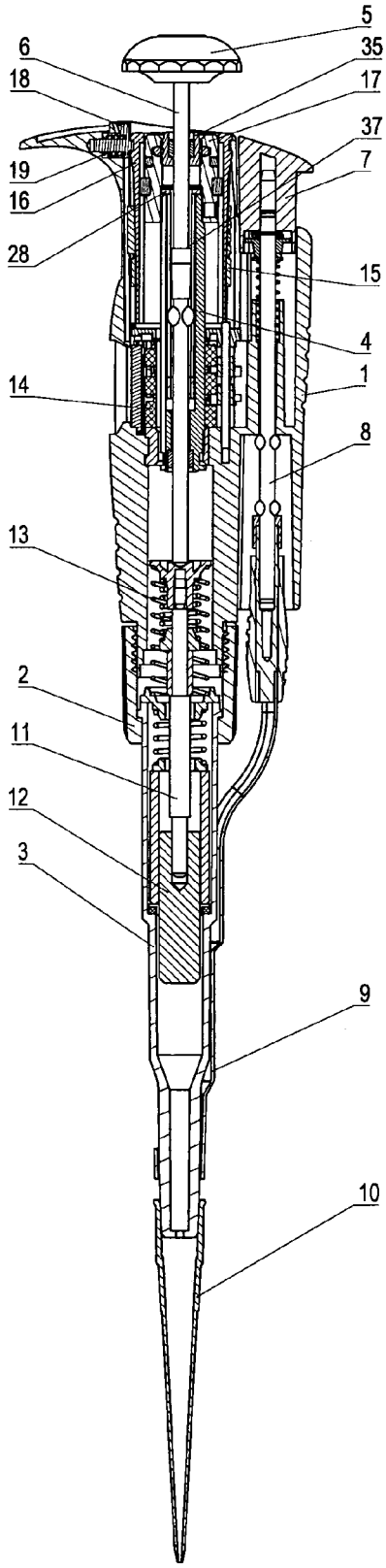
FIG. 1 presents the pipette with the adjustable volume of the aspirated liquid, in longitudinal section, FIG. 2—presents the pipette upper part with the actuated friction brake in LOCKED POSITION of the plunger working stroke adjustment mechanism, in the enlarged longitudinal section, FIG. 3—the pipette upper part with the released friction brake in UNLOCKED POSITION of the plunger working stroke adjustment mechanism, in the longitudinal section, FIG. 4—the pipette upper part in the "exploded" perspective view of the structure internal elements of the handle, a FIG. 5—in enlargement, the perspective view of the lock member of the lock mechanism locking the plunger working stroke adjustment mechanism, which constitutes the braking sleeve.

The pipette with the adjustable volume of the aspirated liquid according to the invention has three operation modes, namely ADJUSTMENT MODE, PIPETTING MODE and CALIBRATION MODE.

The pipette with the adjustable volume of the aspirated liquid, according to the invention, in the preferred embodiment of the invention, is shown in FIG. 1-5. In general, this pipette is built of a handle 1 and of a nozzle 3 and of different mechanisms coupled with them. These mechanisms are: an exchangeable pipette tip ejection mechanism comprising an ejector push-button 7, which is seated in the upper part of the pipette handle 1, and an ejector 9 seated with its lower end onto the pipette nozzle 3; further, a drawing up and discharging mechanism comprising a pipetting push button 5 connected by a pipetting rod 6 with a piston assembly 11, of which a plunger 12 is placed in the pipette nozzle 3; a plunger working stroke adjustment mechanism provided with a drive assembly of an adjustment screw of a plunger working stroke with at least one driving member 16; a manually actuated lock mechanism locking the plunger working stroke adjustment mechanism; an engaging mechanism which engages the plunger working stroke adjustment mechanism with a counter 14 to indicate a volume of the liquid aspirated by the pipette depending on a set plunger working stroke 12 and a calibration mechanism for the change of a pipette calibration coefficient which determines a relationship between a plunger movement length adjusted by the plunger working stroke adjustment mechanism and the liquid volume indicated in said counter 14.

The nozzle 3 is by a nut 2 screwed down to a lower part of the handle 1. To a conic lower end of the nozzle 3 is attached an exchangeable tip 10.

The pipette has disposed longitudinally from one side the exchangeable pipette tip ejection mechanism comprising the ejector push button 7, which is seated in the upper part of the handle 1 of the pipette, and the ejector 9 seated with its lower end onto the pipette nozzle 3. The ejector push button 7 is mounted removably, preferably, by interference connection, onto an ejector rod 8. The rod 8 of the ejector 9 is guided in the hole of the sleeve of the handle 1 and is pushed upward by a spring. The spring abuts by its one end against a shoulder in the sleeve of the handle 1. The spring abuts by its second end against a spring protective assembly which is fixed onto the ejector rod 8 and the spring presses projections of the rod 8 against the lower edge of the sleeve hole of the handle 1 holding the ejector push button 7 in its upper position. The presence of the spring protective assembly causes that after the removal of the ejector push button 7 unintentional falling the ejector 9 out of the handle 1 does not take place. The ejector 9 with its lower end is seated onto the pipette nozzle 3. The lower end of the arm of the ejector 9 at least partially encompasses the cylindrical or conic lower end of the pipette nozzle 3. The ejection edge of the lower end of the ejector arm is situated above the upper edge of the exchangeable tip 10.

The pipette has the drawing up and discharging mechanism which is arranged inside the handle 1 and the nozzle 3 and is used in PIPETTING MODE. The drawing up and discharging mechanism comprises the pipetting push button 5 onto the upper end of the pipette above the handle 1. The pipetting push button 5 is connected via the pipetting rod 6 with the piston assembly 11, of which the plunger 12 is arranged in the pipette nozzle 3. In ADJUSTMENT MODE by means, of the adjustment screw 4 of the drive assembly of the plunger working stroke adjustment mechanism, the position of the upper limiter of the working stroke of the plunger 12 is changed. The upper limiter of the working stroke of the plunger 12 is the lower surface 36 of a calibration tap screw 35, against which an end stop 37 of the pipetting rod 6 bears. The pipetting rod 6 extends from both sides of the adjustment screw 4. The lower end of the pipetting rod 6 via the piston assembly 11 drives the plunger 12 downwardly inside the nozzle 3 against the force of the pipetting spring 13. In PIPETTING MODE of the pipette, in the course of downward motion, the plunger 12 pushes up an air from the nozzle 3 outside the tip 10. After pushing down the pipetting rod 6 to the end, the plunger 12 stops in its lower position. After dipping the tip 10 into the liquid and after releasing the pipetting push button 5, the plunger 12 by the effect of the pipetting spring 13 returns to its upper position sucking in the liquid into the tip 10. To expel the liquid from the tip 10, the pipetting push button 5 should be again pushed down so that the plunger 12 moves to its lower position. To eject the tip 10 from the nozzle 3, the ejector push button 7 should be pressed, which is via the ejector rod 8 connected with the ejector 9. The lower end of the ejector 9 during its downward movement pushes by the ejector edge the tip 10 away from the nozzle 3.

The pipette has in the upper part of the handle 1 disposed the plunger working stroke adjustment mechanism which is applied in ADJUSTMENT MODE and is provided with the drive assembly of the adjustment screw 4 of the plunger working stroke 12. Onto the upper end of the pipette above the handle 1, the pipetting push button 5 is arranged which is fasten onto the pipetting rod 6 so that the rotation of the pipetting push button 5 causes the simultaneous rotation of the pipetting rod 6. As a result, the pipetting push button 5 is the driving member of the plunger working stroke adjustment mechanism. The pipetting rod 6 moves axially inside the adjustment screw 4, whereas inside the adjustment screw 4 a sleeve 28 of the adjustment screw 4 is arranged. The sleeve 28 is provided with two longitudinal grooves 30. The adjustment screw 4 and the sleeve 28 are connected in such a manner that the rotation of one of these elements results in simultaneous rotation of the other one. The pipetting rod 6 has two projections 26 which engage in the grooves 30 of the sleeve 28 so that the pipetting rod 6 can move axially in the sleeve 28, whereas its rotation is transmitted via the projections 26 and the grooves 30 onto the sleeve 28 and, further, from the sleeve 28 via a shape joint 29 onto the adjustment screw 4. In the upper part of the adjustment screw 4 on a fastening surface 27, an inner knob 17 is mounted by three fixing tap bolts 34, into which, in its upper end, a calibration tap screw 35 is screwed. The lower surface 36 of the calibration tap screw 35 constitutes adjustable upper limiter for the end stop 37 of the pipetting rod 6, and the location of the lower surface 36 relative to the handle 1 is altered in ADJUSTMENT MODE by the adjustment screw 4 of the drive assembly of the plunger working stroke adjustment mechanism. The position of the lower surface 36 of the calibration tap screw 35 in the handle 1 determines the upper position of the plunger 12 in the nozzle 3 and a value of the working stroke of the plunger 12 and thereby the value of the volume of the liquid aspirated by the pipette in PIPETTING MODE. The inner knob 17 has on its circumference protrusions 24 which enter into gashes 25 of the driving member 16 of the drive assembly of the adjustment screw 4 enabling free axial displacement of the inner knob 17 relative to the driving member 16 and simultaneously transmission of the torque from the driving member 16 onto the inner knob 17. As a result, the rotation of the one of these elements causes the simultaneous rotation of the other one. Additionally, in the inner knob 17 a rubber ring 41 is arranged of which outside diameter is slightly bigger than an inside diameter of the driving member 16. In the effect, clearances between the inner knob 17 and the driving member 16 are compensated. In this structure, the plunger working stroke adjustment mechanism has two driving members, namely the one being the pipetting push button 5 and the other seated in the handle 1, accessible from the outside through the window 38 in the handle wall and being the driving member indicated in FIGS. 1 to 5 by the numeral reference 16. Thus, the change of the setting value of the aspirated liquid volume in ADJUSTMENT MODE can be performed by the rotation either the pipetting push button 5 or the driving member 16. The driving member 16 on its outer surface in the upper part has a serration roll 33, that is respective surface quality or surface nicks, which facilitates turning the driving member 16 being accessible through the windows 38 in the side wall of the handle 1 with the user fingers for re-adjustment of the aspirated liquid volume in the pipette.

For locking the plunger working stroke adjustment mechanism and changing over the pipette into PIPETTING MODE, between the driving member 16 and the handle 1 in the lower part of the window in the handle 1 a lock member of the lock mechanism locking the adjustment mechanism of the plunger working stroke is arranged. The lock member, in this preferred embodiment of the pipette, has the form of the braking sleeve 15 having a protruding fin 21 which engages in an axially extending groove 20 made in the pipette handle 1. The fin 21 and the groove 20 preclude the braking sleeve 15 from the rotation relative to the handle 1 and simultaneously ensure the possibility of the free displacement of the braking sleeve 15 upward and downward axially in the pipette. The braking sleeve 15 of the lock mechanism of the plunger working stroke adjustment mechanism can slide only axially in the pipette handle 1 and thus it cannot inadvertently turning the driving member 16 during locking the driving member 16 of the plunger working stroke adjustment mechanism and thereby inadvertently change the setting of the movement length of the plunger 12 in the pipette nozzle 3. The inner surface of the braking sleeve 15 has a conic frictional surface 31, and on the outer surface of the driving member 16 also a conic frictional surface 32 is made, which has the same angle of the cone as the frictional surface of the braking sleeve 15. Such configuration of the frictional surfaces 31 and 32 enable, after upward displacement of the braking sleeve 15 along the pipette axis, the mutual locking the braking sleeve 15 and the driving member 16 due to friction forces arisen between the conic frictional surfaces 31 and 32, respectively of the braking sleeve 15 and the driving member 16. These forces produce the moment of frictional forces and thus the braking moment of the plunger working stroke adjustment mechanism, which protects the driving member 16 against the rotation relative to the braking sleeve 15. To facilitate for the pipette user to move slidably the braking sleeve 15 in axial direction, on the periphery of the braking sleeve 15 are provided circumferential grooves 40 which enable a reliable finger grip and displacement of the braking sleeve 15. In the lower part of the braking sleeve 15 a braking element 39 is arranged, which is elastically pressed against the inner surface of the handle wall generating the friction force between the handle 1 and the braking sleeve 15. In the effect, after axial displacement of the lock member, that is the braking sleeve 15, downwards in the window 38 in the handle wall, to UNLOCKED POSITION of the plunger working stroke adjustment mechanism, and thus after release of the friction brake, the braking sleeve 15 is braked in the handle by the friction force generated and does not move freely in the window 38. To prevent the driving member 16 from being slid out from the handle 1 in course of manual displacement of the braking sleeve 15 slidably upward, in the upper part of the driving member 16 on its outer surface a circumferential groove 23 is provided. The circumferential groove 23 engages in a tongue 22 of an interlock 18 of the driving member 16, whereas the interlock 18 is seated in the upper part of the handle 1. The interlock 18 is arranged in the handle 1 so that it can move in perpendicular direction to the pipette longitudinal axis. The interlock 18 is loaded by a spring 19 which causes that the interlock 18 is pressed inwardly toward the driving member 16 and the tongue 22 of the interlock 18 enters the groove 23 of the driving member 16. As a result, the axial movement of the driving member 16 is precluded but the rotation of the driving member 16 is possible. Displacement of the interlock 18 in the direction opposite to the direction of the force generated by the interlock spring 19 causes disengagement of the interlock tongue 22 from the groove 23 of the driving member 16 enabling an easy pipette disassembly.

Figure 2:
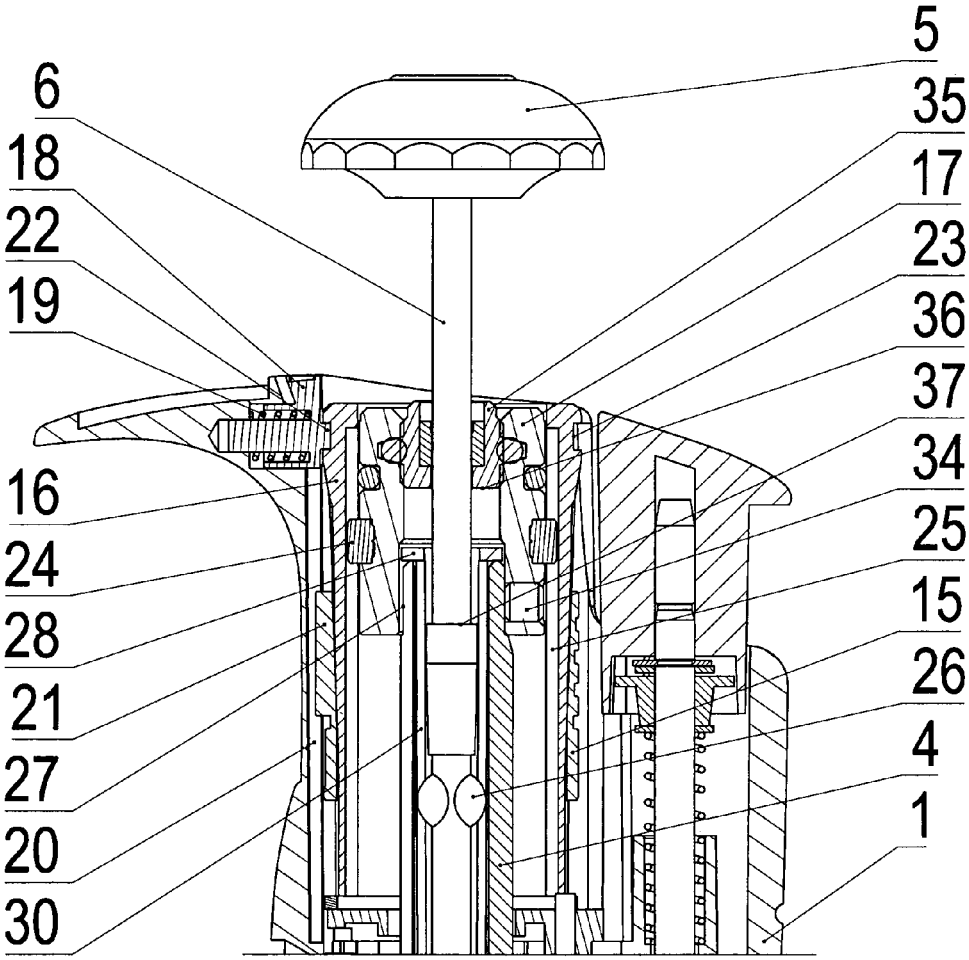

In PIPETTING MODE of the pipette, the plunger working stroke adjustment mechanism has to be in LOCKED POSITION and the lock mechanism has to be actuated, that is, in the described preferred embodiment of the pipette, the friction brake is in the actuated position as it is shown in FIG. 2. In this position, the braking sleeve 15, which is the lock member of the lock mechanism locking the adjustment mechanism of the plunger working stroke, is upwardly displaced so that its conic frictional surface 31 is pressed against the conic frictional surface 32 of the driving member 16. As a result, the friction force arisen between the conic frictional surfaces 31 and 32 generates the braking torque of the rotation of the driving member 16 relative to the braking sleeve 15. Insofar the fin 21 of the braking sleeve 15 is seated in the groove 20 provided in the handle 1 thereby precluding the braking sleeve 15 from the rotation relative to the handle 1, the rotation of the driving member 16 relative to the handle 1 at the friction brake actuated, that is at the braking sleeve 15 upwardly displaced, is also locked. To rotate the driving member 16, it is required to overcome the braking moment which has a large value, in practice, precluding the driving member 16 from its turning by the user fingers. The inner knob 17, which is rigidly affixed by the fixing tap bolts 34 with the adjustment screw 4, has also the locked possibility of the rotation relative to the driving member 16. This is due to the protrusions 24 of the inner knob 17, which enters the axial gashes 25 of the driving member 16. In the effect, the rotation of the adjustment screw 4 in this position of the braking sleeve 15 is locked with the large braking moment. Thus, the adjustment screw 4 is prevented from the accidental rotation and thereby the pipette is prevented from the volume setting change of the drawn-up liquid to the setting which is different than the pre-set one in ADJUSTMENT MODE and desired by the user. Moreover, the upwardly displaced braking sleeve 15 covers partially the driving member 16 of the plunger working stroke adjustment mechanism in the side window 38 in the handle wall, which makes the driving member 16 hard to access for the user thereby precluding from its inadvertent resetting.

Thus, in PIPETTING MODE of the pipette in LOCKED POSITION of the plunger working stroke adjustment mechanism, the braking sleeve 15 is upwardly displaced in the window 38 of the pipette handle 1 and thus the resetting of the drawn-up liquid volume is difficult due to restricted access for the user hand to the driving member 16 of the adjustment mechanism.

Whereas, in ADJUSTMENT MODE of the pipette in UNLOCKED POSITION of the plunger working stroke adjustment mechanism, the braking sleeve 15 is downwardly displaced in the window 38 of the pipette handle 1 and thus facilitates the change of the volume setting of the drawn-up liquid due to improved access for the user hand to the driving member 16 of the adjustment mechanism.

The lock mechanism with the lock member in the form of the braking sleeve 15 is mounted inside the contour of the pipette handle 1, which additionally decreases a danger of misadjustment of the plunger working stroke adjustment mechanism into UNLOCKED POSITION.

Figure 3:
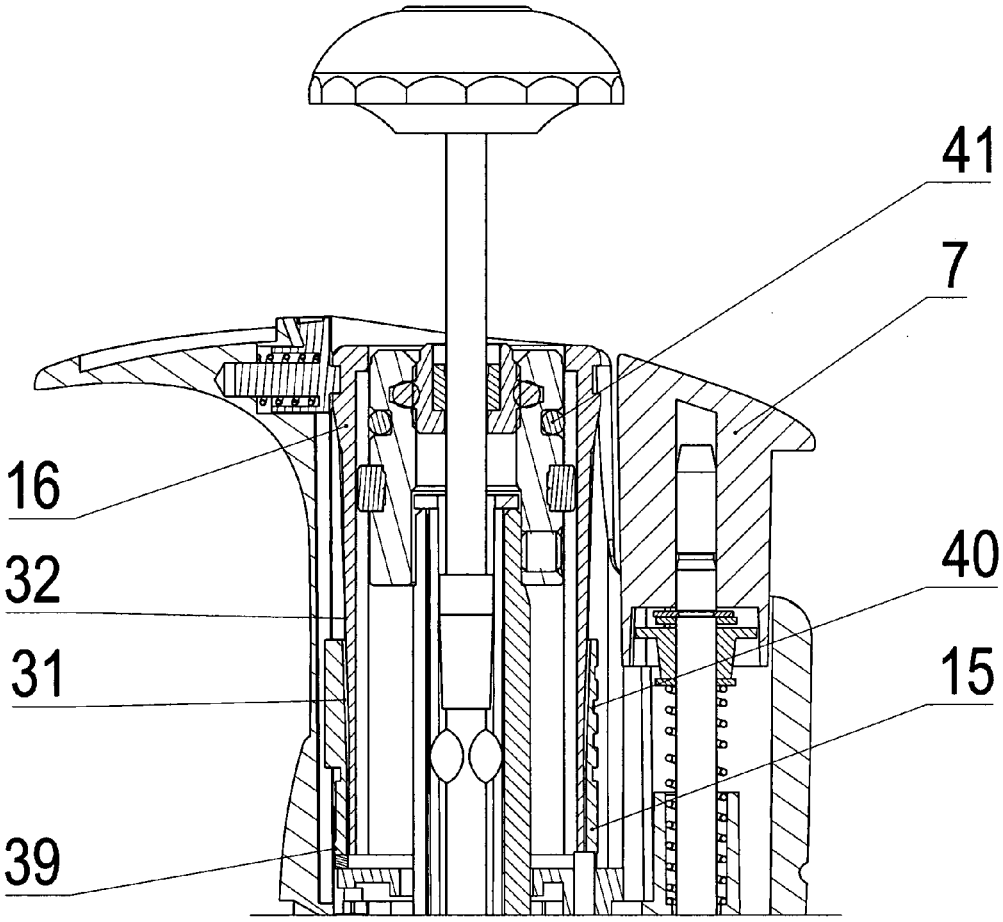
Figure 4:
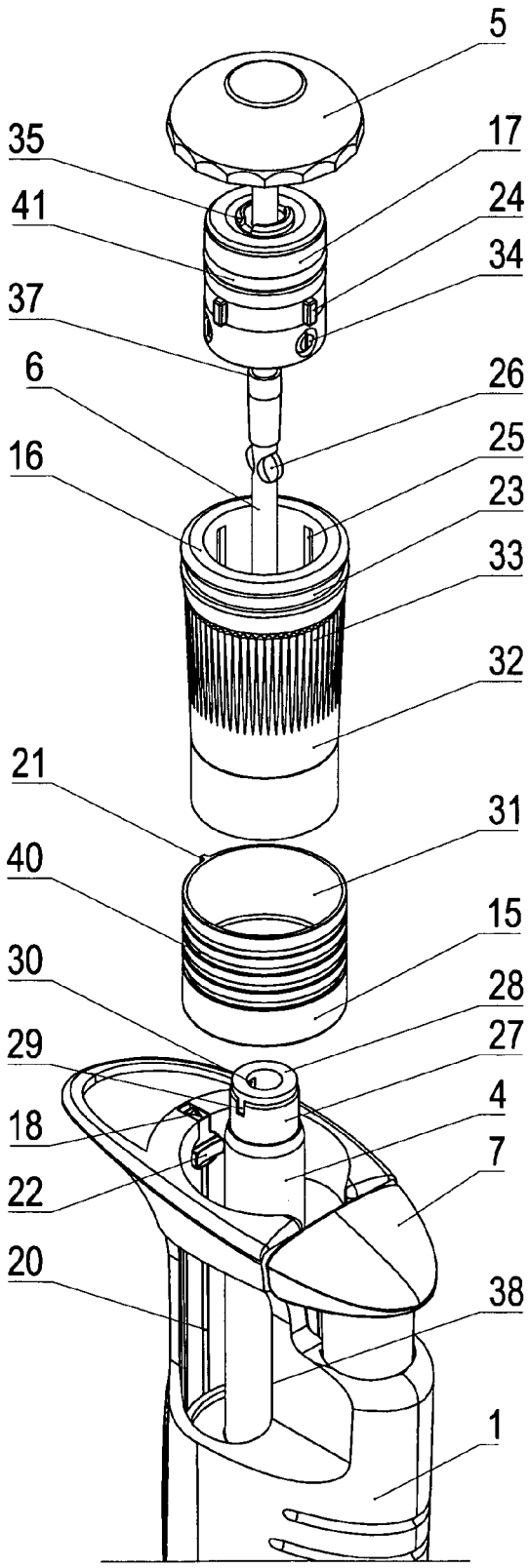
Figure 5:
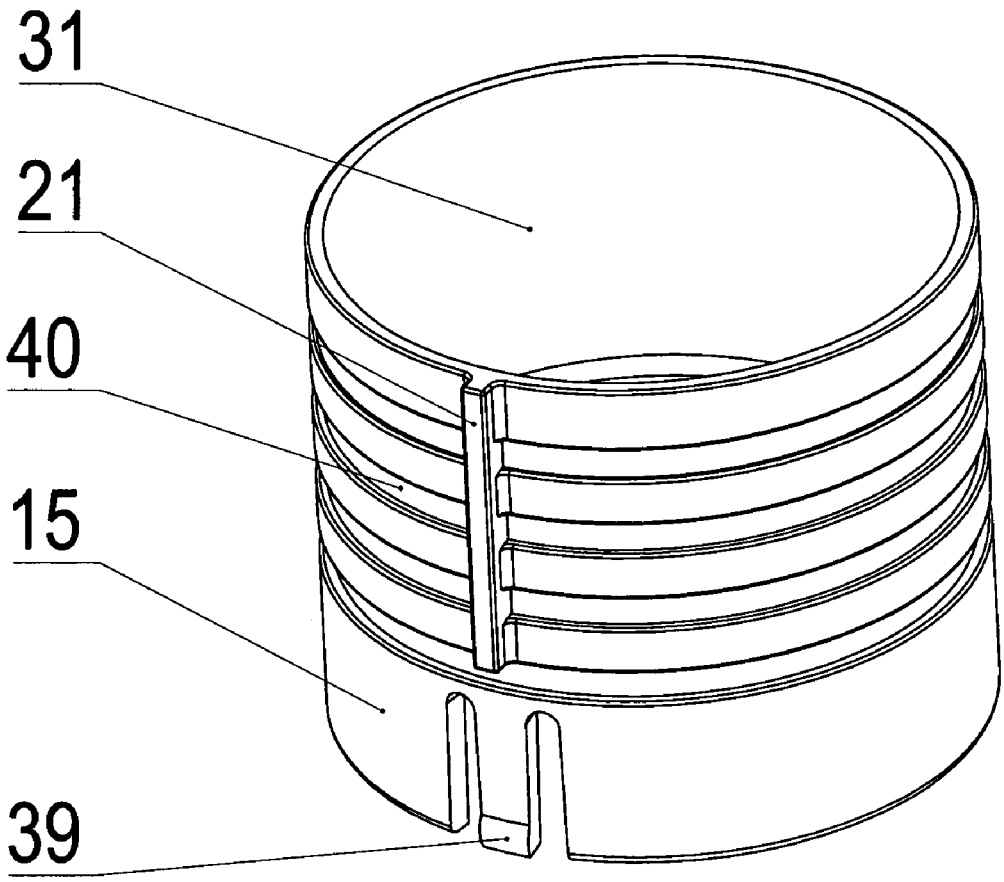

To change the volume setting of the aspirated liquid, the pipette should be changed over into ADJUSTMENT MODE or the plunger working stroke adjustment mechanism into UNLOCKED POSITION, and thus the lock mechanism locking the plunger working stroke adjustment mechanism should be released by release of the friction brake, as it is shown in FIG. 3. In this position, the lock member in the form of the braking sleeve 15 is downwardly displaced so that the conic frictional surface 31 of the braking sleeve 15 and the conic frictional surface 32 of the driving member 16 are disengaged. The driving member 16 can freely rotate relative to the braking sleeve 15. The downwardly displaced braking sleeve 15 uncovers in the side window 38 of the handle 1 the outer surface of the upper part of the driving member 16. This outer surface is provided with the serration roll 33 which enables the user convenient turning the driving member 16 with the fingers. The rotation of the driving member 16 is transmitted via the axial gashes 25 of the driving member 16 onto the protrusions 24 of the inner knob 17, and further via the inner knob 17 and the fixing tap bolt 34 onto the adjustment screw 4. In ADJUSTMENT MODE, while rotating the driving member 16 simultaneously also the adjustment screw 4 is rotated thereby changing the setting of the volume of the liquid aspirated by the pipette. The rotation of the adjustment screw 4 causes the change of the indications of the counter 14 which indicates the value of the aspirated liquid volume for the current position of the adjustment screw 4, and thereby for the current working stroke of the plunger 12 of the piston assembly 11 of the adjustment mechanism.

The plunger working stroke adjustment mechanism is via the engaging mechanism engaged with the counter 14 for indicating the volume of the liquid aspirated by the pipette depending on the set working stroke of the plunger 12.

The other possible manner of the change of the pipette setting in ADJUSTMENT MODE of the pipette in UNLOCKED POSITION of the plunger working stroke adjustment mechanism, that is after release of the friction brake in this preferred embodiment of the invention, is turning with the pipetting push button 5 firmly seated onto the nozzle pipetting 6. The rotation of the pipetting push button 5 causes simultaneous rotation of the pipetting rod 6 because the rotation of the pipetting rod 6 is via the projections 26 of the pipetting rod 6 and via the grooves 30 of the sleeve 28 transmitted onto of the adjustment screw 4. The projections 26 move upward and downward in the grooves 30 of the sleeve 28. The sleeve 28 of the adjustment screw 4 has shape protrusions forming with a recess in the adjustment screw 4 a shape joint 29 due to which the sleeve 28 of the adjustment screw 4 rotates simultaneously with the adjustment screw 4. Thus, by rotating the pipetting push button 5 also the adjustment screw 4 is rotated and thereby the change of the setting of the aspirated liquid volume is performed. The change of settings of the pipette at the released friction brake in UNLOCKED POSITION of the plunger working stroke adjustment mechanism in ADJUSTMENT MODE of the pipette either by rotation of the driving member 16 or by rotation of the pipetting push button 5 is easy and does not require any effort from the user. This is because the braking torque of the pipette adjustment mechanism in ADJUSTMENT MODE of the pipette is very small and does not cause the user tired. The pipette according to the present invention is conveniently operated by the user with one hand.

The lock mechanism locking the plunger working stroke adjustment mechanism is manually actuated and in this exemplary embodiment of the invention is performed as the friction brake between the lock member in the form of the braking sleeve 15 and the driving member 16 of the plunger working stroke adjustment mechanism.

The calibration tap screw 35 in the inner knob 17 mounted in the adjustment screw 4 of the plunger working stroke 12 is the element of the calibration mechanism. The calibration mechanism is necessary in the pipette to change the pipette calibration coefficient determining the relationship between the movement length of the plunger 12, which is set by the plunger working stroke adjustment mechanism, and the liquid volume indicated in the counter 14.

On the basis of the above example embodiments of the invention, it is possible to provide its different changes, modifications and improvements, while such changes, modifications and improvements are obvious in the light of the idea of the invention and the attached hereto patent claims.

LIST OF STRUCTURE ELEMENTS

1. the handle
2. the nut
3. the nozzle
4. the adjustment screw
5. the pipetting push button
6. the pipetting rod
7. the ejector push button
8. the ejector rod
9. the ejector
10. the tip
11. the piston assembly
12. the plunger
13. the pipetting spring
14. the counter
15. the braking sleeve
16. the driving member

17. the inner knob
18. the interlock
19. the interlock spring
20. the groove in the pipette handle
21. the fin of the braking sleeve
22. the tongue of the interlock
23. the groove of the driving member
24. the protrusion of the inner knob
25. the axial groove of the driving member
26. the projection of the pipetting rod
27. the fastening surface of the adjustment screw
28. the sleeve of the adjustment screw
29. the shape joint of the adjustment screw with the sleeve of the adjustment screw
30. the groove of the adjustment screw sleeve
31. the conic frictional surface of the braking sleeve
32. the conic frictional surface of the driving member
33. the serration roll of the driving member
34. the fixing tap bolt
35. the calibration tap screw
36. the lower surface of the calibration tap screw
37. the end stop of the pipetting rod
38. the window in the handle wall
39. the braking element of the braking sleeve
40. the grooves of the braking sleeve
41. the rubber ring

We claim:

1. A pipette with an adjustable volume of an aspirated liquid built of a handle (1) and of a nozzle (3) and of coupled with them an exchangeable pipette tip ejection mechanism comprising an ejector push button (7) seated in the upper part of said handle (1) and an ejector (9) seated with its lower end onto said nozzle (3), a drawing up and discharging mechanism comprising a pipetting push button (5) connected via a pipetting rod (6) with a piston assembly (11) of which a plunger (12) is placed in said nozzle (3), a plunger working stroke adjustment mechanism provided with a drive assembly of an adjustment screw of a plunger working stroke with at least one driving member (16), a manually actuated lock mechanism locking said plunger working stroke adjustment mechanism, an engaging mechanism engaging said plunger working stroke adjustment mechanism with a counter (14) for indicating a volume of a liquid aspirated by said pipette depending on the set plunger working stroke, a calibration mechanism for a change of a pipette calibration coefficient determining a relationship between a plunger movement length which is set by said plunger working stroke adjustment mechanism and the liquid volume indicated in said counter, whereas said driving member (16) of said drive assembly of said adjustment screw of the plunger working stroke is accessible from outside through at least one window (38) in a wall of said handle (1), characterised in that said lock mechanism locking said plunger working stroke adjustment mechanism comprises a lock member which is non-rotatably mounted relative to said pipette handle (1) and is axially slidable along an axis defined by the pipetting rod (6) between LOCKED POSITION and UNLOCKED POSITION of said plunger working stroke adjustment mechanism, whereas said driving member (16) of said drive assembly of said adjustment screw of the plunger working stroke is axially fixedly and rotatably mounted relative to said pipette handle (1), and said lock mechanism locking said plunger working stroke adjustment mechanism constitutes a friction brake between said lock member and said driving member (16), whereas said lock member has a frictional surface (31) on an inner cone and said driving member (16) has a frictional surface (32) on an outer cone.

2. The pipette according to claim 1, characterised in that said driving member (16) of said drive assembly of said adjustment screw of the plunger working stroke is via said pipetting rod (6) rotatably fixedly coupled with said pipetting push button (5) of said drawing up and discharging mechanism.

3. The pipette according to claim 1, characterised in that said lock member is axially slidably mounted onto said driving member (16) of said drive assembly of said adjustment screw of the plunger working stroke and non-rotatably mounted in said pipette handle (1).

4. The pipette according to claim 1, characterised in that angles of said inner and outer cones of said frictional surfaces (31, 32) are equal.

5. The pipette according to claim 1, characterised in that said lock member is a braking sleeve (15).

6. The pipette according to claim 1, characterised in that said lock member is provided with an elastic braking element (39) braking an axial movement of said lock member in said pipette handle (1) in UNLOCKED POSITION of said plunger working stroke adjustment mechanism.

7. The pipette according to claim 1, characterised in that said driving member (16) of said drive assembly of said adjustment screw of the plunger working stroke is axially fixedly mounted relative to said pipette handle (1) by an interlock (18) which is releasable from said driving member (16) for axial displacing said driving member (16) during the pipette disassembly.

8. The pipette according to claim 1, characterised in that said lock member has an outer surface which facilitates a grip.

9. The pipette according to claim 2, characterised in that said lock member is axially slidably mounted onto said driving member (16) of said drive assembly of said adjustment screw of the plunger working stroke and non-rotatably mounted in said pipette handle 1).

10. The pipette according to claim 9, characterised in that angles of said inner and outer cones of said frictional surfaces (31, 32) are equal.

11. The pipette according to claim 10, characterised in that said lock member is a braking sleeve (15).

12. The pipette according to claim 3, characterised in that angles of said inner and outer cones of said frictional surfaces (31, 32) are equal.

13. The pipette according to claim 12, characterised in that said lock member is a braking sleeve (15).

14. The pipette according to claim 4, characterised in that said lock member is a braking sleeve (15).

15. The pipette according to claim 14, characterised in that said lock member is provided with an elastic braking element (39) braking an axial movement of said lock member in said pipette handle (1) in UNLOCKED POSITION of said plunger working stroke adjustment mechanism.

16. The pipette according to claim 5, characterised in that said lock member is provided with an elastic braking element (39) braking an axial movement of said lock member in said pipette handle (1) in UNLOCKED POSITION of said plunger working stroke adjustment mechanism.

17. The pipette according to claim 16, characterised in that said driving member (16) of said drive assembly of said adjustment screw of the plunger working stroke is axially fixedly mounted relative to said pipette handle (1) by an interlock (18) which is releasable from said driving member (16) for axial displacing said driving member (16) during the pipette disassembly.

18. The pipette according to claim 6, characterised in that said driving member (16) of said drive assembly of said adjustment screw of the plunger working stroke is axially fixedly mounted relative to said pipette handle (1) by an interlock (18) which is releasable from said driving member (16) for axial displacing said driving member (16) during the pipette disassembly.

19. The pipette according to claim 18, characterised in that said lock member has an outer surface which facilitates a grip.

20. The pipette according to claim 7, characterised in that said lock member has an outer surface which facilitates a grip.

* * * * *

UNITED STATES PATENT AND TRADEMARK OFFICE

CERTIFICATE OF CORRECTION

PATENT NO. : 8,357,337 B2
APPLICATION NO. : 12/680686
DATED : January 22, 2013
INVENTOR(S) : Romuald Andrzej Rylski It is certified that error appears in the above-identified patent and that said Letters Patent is hereby corrected as shown below:

In the Specifications:

Move block of text starting at Column 3, line 67 and ending at Column 5, line 33, excluding phrase "pipette is in PIPET", to Column 6, between lines 16 and 17.

Signed and Sealed this
Twenty-third Day of April, 2013

Teresa Stanek Rea
*Acting Director of the United States Patent and Trademark Office*